US006279587B1

(12) United States Patent
Yamamoto

(10) Patent No.: US 6,279,587 B1
(45) Date of Patent: Aug. 28, 2001

(54) PARTS WASHER WITH SOLVENT RECYCLING

(76) Inventor: Soichiro Yamamoto, 2 Allen Manner, Unionville, Ontario (CA), L6C 1B2

( * ) Notice: Subject to any disclaimer, the term of this patent is extended or adjusted under 35 U.S.C. 154(b) by 0 days.

(21) Appl. No.: 09/289,743

(22) Filed: Apr. 12, 1999

(51) Int. Cl.[7] ..... B08B 3/02

(52) U.S. Cl. ..... 134/57 R; 134/111; 134/104.2; 134/104.4

(58) Field of Search ..... 134/56 R, 57 R, 134/58 R, 110, 111, 104.2, 104.4

(56) References Cited

U.S. PATENT DOCUMENTS

| | | | | |
|---|---|---|---|---|
| 2,385,150 | * | 9/1945 | Miller | 134/111 |
| 2,595,838 | * | 5/1952 | Fuglie | 134/111 |
| 2,646,585 | * | 7/1953 | Whittington | 134/111 |
| 2,675,012 | * | 4/1954 | Scales . | |
| 2,721,566 | * | 10/1955 | Brucker . | |
| 3,156,248 | * | 11/1964 | Rand | 134/111 |
| 3,352,310 | * | 11/1967 | Doyscher | 134/111 |
| 3,416,544 | * | 12/1968 | Paiva | 134/111 |
| 3,971,394 | * | 7/1976 | Osboren | 134/104.1 |
| 4,353,381 | * | 10/1982 | Winters | 134/111 |
| 4,688,585 | * | 8/1987 | Vetter | 134/56 R |
| 5,303,725 | * | 4/1994 | Hilgren | 134/56 R |
| 5,349,974 | | 9/1994 | Mansur . | |
| 5,401,328 | * | 3/1995 | Schmitz | 134/58 R |
| 5,470,477 | * | 11/1995 | Fransworth . | |
| 5,518,013 | | 5/1996 | Mansur . | |
| 5,549,128 | | 8/1996 | Mansur . | |
| 5,669,401 | | 9/1997 | Mansur . | |
| 5,769,912 | | 6/1998 | Mansur . | |
| 5,827,374 | | 10/1998 | Mansur . | |
| 5,924,148 | * | 7/1999 | Flowers . | |

* cited by examiner

*Primary Examiner*—Frankie L. Stinson
(74) *Attorney, Agent, or Firm*—Ridout & Maybee LLP

(57) ABSTRACT

A parts washer is disclosed of the type having a sink, a drum of solvent, and a recirculating system for pumping the solvent from the drum through a hose or nozzle arrangement for spraying the solvent on the parts to be washed in the sink, and then allowing the solvent to drain from the sink back into the solvent drum. In this invention, the solvent drum is fitted with an extra clean-out tube for withdrawing contaminated solvent from the drum, and a return tube for replenishing the drum with clean solvent. The clean-out tube and return tube are fitted with quick-connect couplings for releasably attaching solvent cleaning apparatus thereto, such as filtration or distillation type recycling apparatus.

18 Claims, 2 Drawing Sheets

PARTS WASHER WITH SOLVENT RECYCLING

FIELD OF THE INVENTION

This invention relates to manual parts washers, and in particular, to parts washers for cleaning such things as automotive parts, machinery parts and various items of equipment, using appropriate solvents.

SUMMARY OF THE INVENTION

Manual parts washers are commonly used in many industries, and are particularly popular in the automotive service sector. The most basic type of parts washer includes a metal cleaning sink with a hinged lid. The sink is mounted on top of a conventional sixteen or thirty gallon drum of solvent. Solvent is applied to the parts to be washer through a brush mounted on the end of a hose, or through a fixed nozzle in a faucet-like arrangement. Usually, a submersible pump is located in the drum to supply the solvent to the cleaning brush or nozzle.

As the parts are washed, the solvent becomes contaminated with various contaminants, such as dirt, metal particles, oil, grease, paint, etc., and the contaminated solvent drains back into the drum through a drain hole in the bottom of the sink. Sometimes a filtration unit is provided to catch solid particulate contaminants before the contaminated solvent returns to the drum, but filtration devices are not effective for removing dissolved contaminates, such as greases and oils. Eventually, even with good filtering systems and frequent replacement of the filter elements used therein, the solvent becomes contaminated to the point where the drum of contaminated solvent has to be replaced with a new drum of fresh solvent. This is expensive and results in down-time while the solvent drum is being replaced.

In order to overcome these disadvantages, it has been proposed to incorporate a solvent recycling unit, such as a distillation apparatus, right into the parts washer. When the solvent becomes too contaminated, the solvent is transferred from the solvent drum to the recycling unit, where it is cleaned, and then the solvent is returned to the solvent drum. While this reduces the cost of replacing the solvent, a difficulty with this arrangement is that the parts washer cannot be used while the solvent is going through the recycling process. Further, recycling apparatus is prone to breakdown, and if a breakdown occurs during the recycling process, the parts washer is out of commission totally until the recycling apparatus is repaired.

In the present invention, the parts washer is adapted to be coupled to an independent recycling apparatus that continuously cleans the solvent, so that the parts washer is usable at all times, and if the recycling apparatus breaks down, it can simply be replaced with another unit without affecting the operation of the parts washer.

According to the invention, there is provided a parts washer comprising a cleaning sink having a bottom wall defining a sink drain therein. A solvent delivery tube is attached to the sink and has an outlet device for directing solvent onto a part to be washed in the sink. A solvent container is located below the sink. The container is adapted to contain cleaning solvent and has an inlet opening for receiving solvent from the sink drain. The container also has a container wall including a bottom wall portion. An extraction conduit extends into the solvent container for withdrawing solvent from the container. The extraction conduit is connected to the solvent delivery tube. A pump is operatively coupled to the extraction conduit for pumping solvent from the container to the solvent delivery tube. A clean-out tube extends into the container to a location adjacent to the container bottom wall portion. The clean-out tube has an outlet end portion located outside of the container. Also, means are provided for activating the pump for circulating solvent from the container, through the solvent delivery tube and back to the container.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
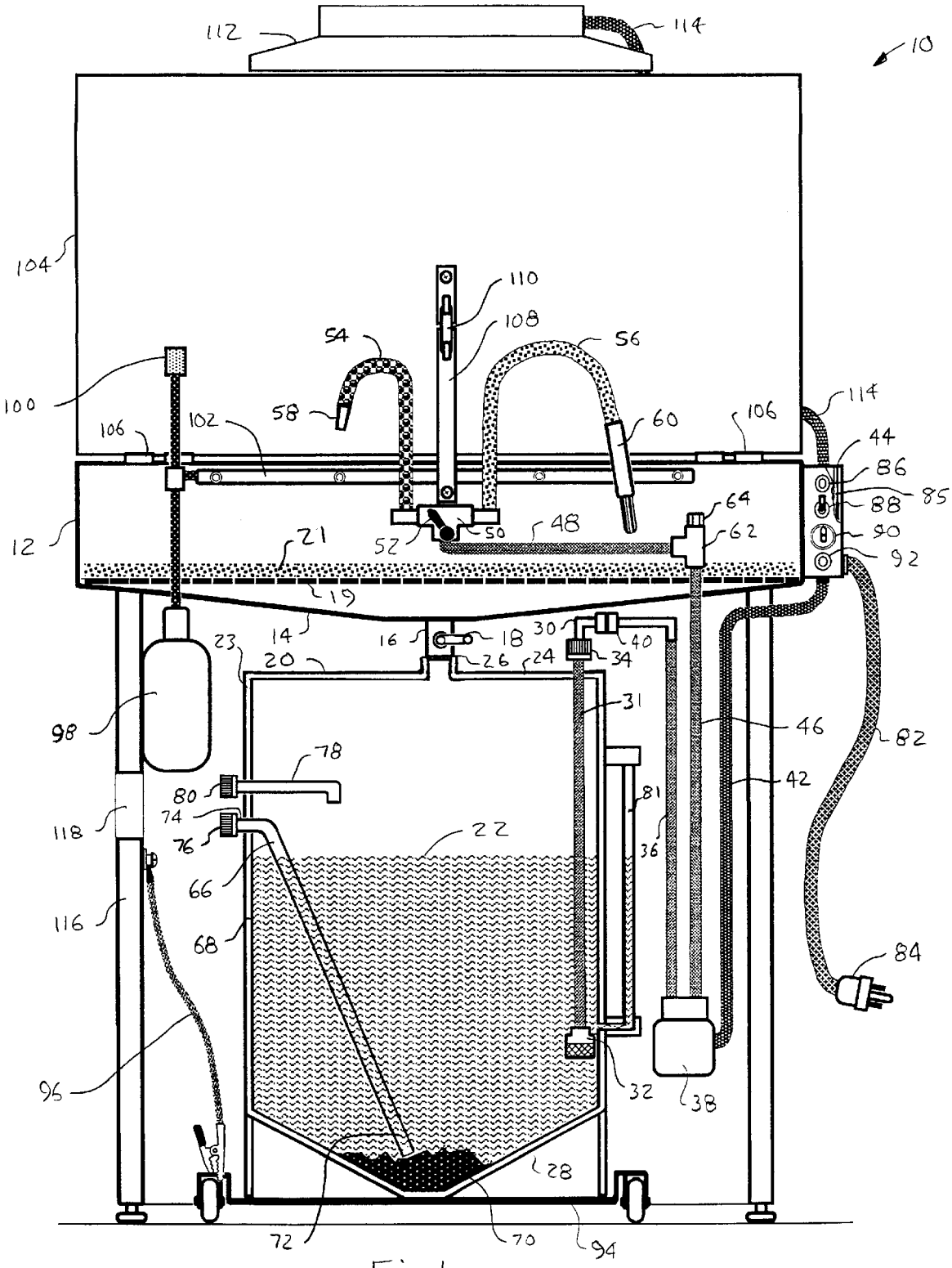
FIG. 1 is a diagrammatic elevational view, partly in section, showing a preferred embodiment of a parts washer according to the present invention.

Referring to the drawings, a preferred embodiment of a parts washer according to the present invention is generally indicated by reference numeral 10. Parts washer 10 includes a cleaning sink 12 typically made of steel, stainless steel or a suitable plastic material that will withstand the solvent used in parts washer 10. Sink 12 preferably has a bottom wall 14 that is tapered or slopes downwardly to a sink drain 16. Sink drain 16 includes an optional valve 18 to close the drain.

Sink 12 includes a wire mesh support filter screen 19. Support screen 19 has small openings and also functions as a flame arrestor. A filter pad 21 of relatively coarse material is located on top of support screen 19 to prevent large pieces of debris from passing through drain 16 into tank 20.

A solvent container or drum 20 is located below sink 12 and typically contains from about 10 to 17 gallons of solvent 22. Any type of solvent can be used in the present invention, either petroleum or water based. Container 20 has a container wall 23 including an upper wall portion 24 which defines an inlet opening 26 for receiving solvent from sink drain 16 when valve 18 is open. Container wall 23 also has a bottom wall portion 28, which is preferably tapered or conical, although it could be a plain flat bottom wall, if desired. An extraction conduit 30 extends into solvent container 20 and extends through or from container wall 24 for withdrawing solvent from container 20. Extraction conduit 30 has a lower inlet strainer 32, which is formed of relatively course mesh to prevent foreign particles over 2 to 3 mil. from entering extraction conduit 30.

Extraction conduit 30 includes a suction line 31, an inlet suction hose 36, and an outlet hose 46. Suction line 31 is connected by a quick-connect type connector 34 to inlet suction hose 36 leading to a pump 38. Inlet suction hose 36 could be a flexible hose or a rigid pipe, as desired. An optional swivel connector 40 may be located in inlet suction hose or line 36, in which case, quick-connect coupling 34 may be replaced with a regular threaded connector, or both quick-connect connector 34 and swivel connector 40 could be used together if desired. Quick-connect connector 34 and/or swivel connector 40 are used to facilitate removal of container 20 from parts washer 10, as will be described further below.

Pump 38 is preferably an electric centrifugal pump powered through electrical wiring 42 leading from a control box 44. Any other type of pump could be used for pump 38, such as an air driven pump, but the latter would require a supply of compressed air for operation and a suitable solenoid valve, as will be appreciated by those skilled in the art.

Outlet hose or conduit 46 supplies solvent from pump 38 to a solvent delivery tube 48 attached to or located in sink 12. Delivery tube 48 delivers the solvent to a manifold 50 which includes a three-way valve 52 for directing the solvent either to a flexible outlet tube 54, or a flexible hose 56, or to both tube 54 and hose 56. Outlet tube 54 has an outlet nozzle 58 for directing or spraying solvent onto a part to be washed in sink 12. Flexible hose 56 supplies solvent through a cleaning brush 60.

As mentioned above, pump 38 is a centrifugal pump, and as such, this type of pump usually has a low suction head. Accordingly, a priming fitting or T-fitting 62 with a removable plug 64 is provided so that outlet hose 46, pump 38 and suction hose 36 can be filled with solvent through fitting 62 to prime pump 38 during initialization of parts washer 10. Once pump 38 is primed initially, it normally does not have to be primed again unless hoses 36 and 46 are drained or emptied of solvent.

Container 20 also includes a clean-out tube 66 which passes through container sidewall 68. Clean-out tube 66 preferably extends to a location adjacent to the container bottom wall portion 28 to suck out any debris or solid contaminates 70 from the bottom of container 20. However, the lower end portion or inlet 72 of clean out tube 66 only needs to be below the surface of solvent 22 during all normal operating levels of solvent 22. For the purposes of this disclosure, where it is stated that clean-out tube 66 extends to a location adjacent to the container bottom wall portion, the term "adjacent to" is intended to include any position as long as inlet portion 72 is normally below the surface of solvent 22.

Clean-out tube 66 also has an outlet end portion 74 located outside container 20, and a quick-connect coupling 76 is provided on the end of outlet end portion 74 for attaching clean-out tube 66 to a recycling unit or apparatus, as will be described further below.

Container 20 is also provided with a return tube 78 passing through container wall 68. Return tube 78 also has a quick-connect coupling 80 mounted thereon for attaching return tube 78 to the outlet of a recycling unit, also as described further below.

Quick-connect couplings 76, 80 are the female components of these type of couplings and thus are normally closed to prevent solvent 22 from escaping through clean-out tube 66 and return tube 78 even where the level of solvent 22 rises above tubes 66 and 78. The normally closed components of couplings 76 and 80 are opened by the male portion of the mating coupling component. Quick-connect coupling 80 forms the inlet end portion of return tube 78 and of course, is located outside container 20. Quick-connect coupling 76 forms an outlet end portion of clean-out tube 66 and is also located outside of container 20. Quick-connect couplings 76,80 can be used also for easy emptying of container 20 and refilling it with fresh solvent, where recycling facilities are not available, or for connecting container 20 to an outside reservoir or drum of solvent, if desired.

Electrical power is provided to parts washer 10 by an electrical cord 82 having a conventional electrical plug 84 mounted on the end thereof. Power is supplied through cord 82 to suitable terminals inside control box 44. Control box 44 contains an indicator light 86 to indicate that the power is on to parts washer 10, an on/off switch 88, a delay timer 90 for operating pump 38, as will be described further below, and a proximity sensor 92 for sensing the presence of an operator of the parts washer, the purpose of which will also be described further below. These components are controlled by a microprocessor circuit board 85, as described next below.

As an operator approaches parts washer 10, proximity sensor 92 senses this and microprocessor 85 starts timer 90. Timer 90 delays the start of pump 38 for a short period of time in case the operator is just walking by the parts washer. If the operator remains by the parts washer however, timer 90 causes pump 38 to be turned on. Timer 90 can also ensure that the pump stays on for a predetermined time interval, such as a few minutes if the operator walks away from the parts washer for a short period of time. However, timer 90 ensures that the pump does not keep running beyond a second predetermined period of time such as five minutes or so, if no one is around parts washer 10. Timer 90 can be set to operate pump 38 for anywhere from a few minutes to twenty or thirty minutes or longer if desired. If desired, pump 38 can also be operated manually using on/off switch 88. Also, if desired, timer 90 could be eliminated and pump 38 operated simply by proximity sensor 92. Whether parts washer 10 is operated manually or automatically by timer 90 and/or proximity sensor 92, it will be appreciated that when pump 38 is activated, solvent 22 is circulated from container 20, through pump 38 to solvent delivery tube 48 and thus either to nozzle 58 or cleaning brush 60. The solvent then drains through sink drain 16 and returns to container 20.

Proximity sensor 92 can be any type of proximity sensor, such as an infra red device, a motion sensor or a light beam type of device.

Solvent container 20 is mounted on a dolly 94, so that container or tank 20 can be easily pulled out and replaced with another tank or drum. This might be desirable, for example, where it is desired to change to a different type of solvent Dolly 94 also makes it easy to install container or tank 20 initially. A ground strap 96 is provided to prevent static electricity discharges. A fire extinguisher 98 is provided in case of fire. A heat sensing head 100 senses heat from fire and activates fire extinguisher 98 releasing the appropriate chemicals into sink 12 through a distribution tube or manifold 102. Parts washer 10 is provided with a hood or lid 104 which is attached to sink 12 by hinges 106. A lid stay 108 is provided to hold lid 104 open, but lid stay 108 is provided with a fusible link 110 to close lid 108 automatically in the event of fire. A work light 112 is provided to illuminate the washing area. Power is supplied to work light 112 by a cable 114. If desired, work light 112 can be turned on and off automatically when pump 38 is turned on and off.

Sink 12 is mounted on a base or cabinet 116, so that container 20 can be replaced without having to lift or move sink 12. Base or cabinet 116 includes an access opening 118 to allow hoses to pass therethrough from a solvent reservoir or a solvent recycling unit to be connected to quick-connect couplers 76, 80.

A tank level indicator 81 in the form of a sight glass is provided to indicate the level of solvent 22 in container 20. However, other types of level indicators can be used in parts washer 10. If an electronic level indicator is used, a signal could be provided to shut-off pump 38 in the event that the solvent level drops below the level of strainer 32, or if the solvent level rises too high in container 20. An electronic level indicator would be connected to microprocessor circuit board 85, and a sound alarm or flashing lights could also be employed to signal a low or high limit being reached for solvent 22.

Figure 2:
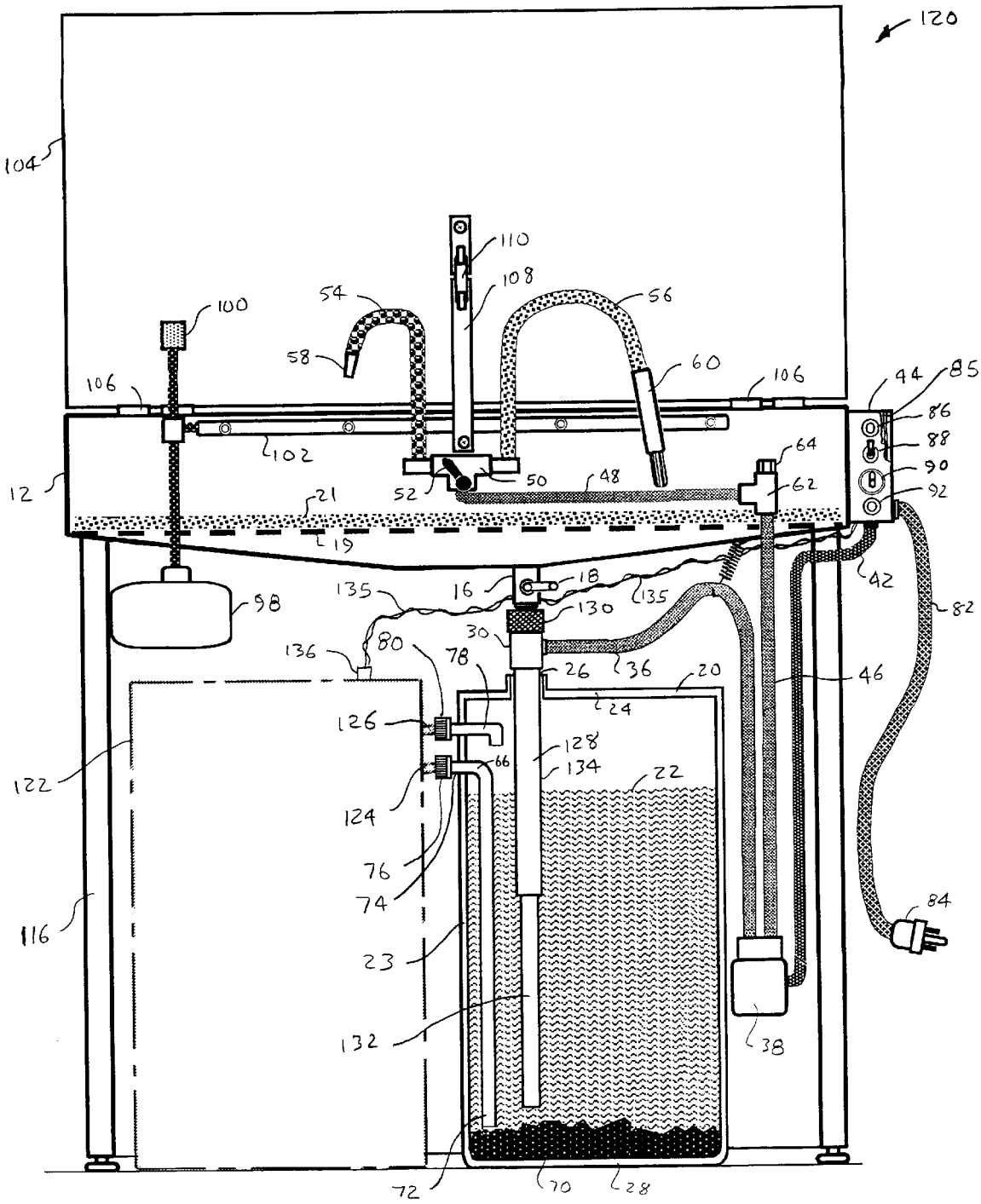
FIG. 2 is an elevational view similar to FIG. 1 but showing some modifications to the embodiment shown in FIG. 1.

Referring next to FIG. 2, a parts washer 120 is shown, which is a modification of parts washer 10. Like reference numerals are used in FIG. 2 to indicate parts or components that are similar to those of the embodiment shown in FIG. 1. In parts washer 120, room is provided in cabinet 116 for a solvent recycling unit or apparatus 122 indicated by chain dotted lines. Recycling apparatus 122 has an inlet line 124 releasably coupled to the clean-out tube outlet end portion or quick-connect coupling 76. Recycling apparatus 122 also has an outlet line 126 connected to quick-connect coupling 80 to deliver recycled solvent back to container 20 through return tube 78. If desired, outlet line 126 could be attached to a hose or tube going directly into sink 12, in which case, return tube 78 could be eliminated. Recycling unit or apparatus 122 is electronically connected to microprocessor circuit board 85 by a control cable 135 connected to recycling apparatus 122 by a releasable or quick-connect type connector 136. If desired, power could be supplied to recycling apparatus 122 through cable 135, or a separate power supply cord could be employed on recycling apparatus 122.

A drain extension tube 128 is releasably connected to sink drain 16 by a quick-connect coupling 130. Extension tube 128 has an internal or central tube 132 which communicates with sink drain 16, and an outer concentric tube 128 which is of larger diameter than inner central tube 132. The annular space between central tube 132 and outer tube 134 becomes the suction line of solvent extraction conduit 30 and communicates with inlet suction hose 36 to form the inlet for pump 38. If desired, sink drain 16 could have an extension tube that is connected directly to return tube 78. Where recycling apparatus 122 is not present or outlet line 126 is disconnected from quick-connect coupling 80, the central tube 132 could have its own quick-connect coupling which releasably connects tube 132 to quick-connect coupling 80. In this case, inlet suction hose 36 could be connected to outer tube 134 and be like a suction line 30 in the embodiment shown in FIG. 1.

Solvent recycling apparatus 122 could be a filtering apparatus, or it could be a distillation unit. It is desired, however, that recycling apparatus 122 be able to operate while parts washer 120 is operating. Recycling apparatus 122 can operate continuously or intermittently, but it is desired that pump 38 be able to operate even when recycling apparatus 122 operates. Of course, recycling apparatus 122 could be operated manually, by its own on/off switch, or it could be controlled by microprocessor circuit board 85 through control cable 135.

Having described preferred embodiments of the invention, it will be appreciated that various modifications may be made to the structures described above. For example, pump 38 could be a submersible pump and be located inside container 20. Suction line 31 and inlet suction hose 36 would then not be required and only outlet hose 46 would come out of tank 20. Outlet hose 46 could then be provided with a quick-disconnect coupling to allow for the removal of tank 20 from parts washer 120. It will be noted that tank 20 in parts washer 120 is not mounted on a dolly as in the case of FIG. 1. However, a dolly could be provided in parts washer 120 if desired. Parts washers 10 and 120 are shown to have both an outlet tube and nozzle 54,58 and a flexible hose and brush 56,60, although only one or the other of these combinations could be used in either parts washer. Where only one type of solvent delivery device is used, manifold 50 would not be required.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A parts washer comprising:

a cleaning sink having a bottom wall defining a sink drain therein;

a solvent delivery tube attached to the sink and having an outlet device for directing solvent onto a part to be washed in the sink;

a solvent container located below the sink, the container being adapted to contain cleaning solvent and having an inlet opening for receiving solvent from the sink drain, the container also having a container wall including a bottom wall portion;

an extraction conduit extending into the solvent container for withdrawing solvent from the container, the extraction conduit being connected to the solvent delivery tube;

a pump operatively coupled to the extraction conduit for pumping solvent from the container to the solvent delivery tube;

a clean-out tube extending into the container through the container wall to a location adjacent to the container bottom wall portion, the clean-out tube having an outlet end portion located outside the container;

a return tube passing through the container wall for returning solvent to the container, the return tube having an inlet end portion, located outside the container; and means for activating the pump for circulating solvent from the container, through the solvent delivery tube and back to the container.

2. A parts washer as claimed in claim 1 and further comprising an extension tube coupled to the sink drain, the extension tube being coupled to the return tube inlet end portion.

3. A parts washer as claimed in claim 1 and further comprising an extension tube coupled to the sink drain, the extension tube passing through the container wall inlet opening.

4. A parts washer as claimed in claim 3 and further comprising a quick-connect coupling attaching the sink drain to the sink drain extension tube.

5. A parts washer as claimed in claim 1 and further comprising quick-connect couplings attached to each of the clean-out tube outlet end portion and the return tube inlet end portion.

6. A parts washer as claimed in claim 1 wherein the pump is a centrifugal pump located outside the container between the extraction conduit and the solvent delivery tube.

7. A parts washer as claimed in claim 6 wherein the extraction conduit includes an outlet end portion located outside the container, and further comprising a quick-connect coupling for connecting the extraction conduit to the pump.

8. A parts washer as claimed in claim 6 and further comprising a priming fitting located between the pump and the solvent delivery tube for priming the pump with solvent.

9. A parts washer as claimed in claim 1 wherein the pump activating means includes a timer for operating the pump for a predetermined time interval after being turned on.

10. A parts washer as claimed in claim 9 wherein the pump activating means includes a proximity sensor adapted to turn the pump on upon sensing the presence of an operator of the parts washer.

11. A parts washer as claimed in claim 10 wherein the timer further includes means for delaying the pump turn on after the activating means senses the presence of an operator.

12. A parts washer as claimed in claim 10 wherein the proximity sensor is a motion sensor.

13. A parts washer as claimed in claim 9 and further comprising a microprocessor circuit board, said circuit board including the timer and being part of the pump activating means.

14. A parts washer as claimed in claim 3 and further comprising a control cable electronically connecting the recycling apparatus to the microprocessor circuit board.

15. A parts washer as claimed in claim 1 and further comprising a tank level indicator adapted to sense and indicate the level of solvent in the container.

16. A parts washer as claimed in claim 1 and further comprising a solvent recycling apparatus having an inlet line releasably coupled to the clean-out tube outlet end portion, and an outlet line for delivering recycled solvent back to the parts washer.

17. A parts washer as claimed in claim 16 wherein the recycling apparatus outlet line is positioned to discharge into the sink.

18. A parts washer as claimed in claim 16 and further comprising a return tube passing through the container wall for returning solvent to the container, the return tube having an inlet end portion located outside the container, and wherein the recycling apparatus outlet line is releasably coupled to the return tube inlet end portion.

* * * * *